US006763550B2

(12) United States Patent
Regnier

(10) Patent No.: US 6,763,550 B2
(45) Date of Patent: Jul. 20, 2004

(54) WINDOW REGULATOR CHANNEL SLIDER DEVICE

(75) Inventor: Luc Roger Regnier, Toronto (CA)

(73) Assignee: Intier Automotive Closures Inc., Newmarket (CA)

( * ) Notice: Subject to any disclaimer, the term of this patent is extended or adjusted under 35 U.S.C. 154(b) by 0 days.

(21) Appl. No.: 10/381,612

(22) PCT Filed: Sep. 27, 2001

(86) PCT No.: PCT/CA01/01363

§ 371 (c)(1),
(2), (4) Date: Mar. 26, 2003

(87) PCT Pub. No.: WO02/26402

PCT Pub. Date: Apr. 4, 2002

(65) Prior Publication Data

US 2004/0107535 A1 Jun. 10, 2004

Related U.S. Application Data

(60) Provisional application No. 60/235,688, filed on Sep. 27, 2000.

(51) Int. Cl.[7] ..... E05D 15/00; E05D 13/00

(52) U.S. Cl. ..... 16/193; 16/93 R; 49/375; 49/428; 49/440

(58) Field of Search ..... 16/93 R, 193, 16/199, 93 D, 90, 95 R; 49/181, 176, 428, 404, 374, 375, 350, 351, 440, 441

(56) References Cited

U.S. PATENT DOCUMENTS

| | | | | | |
|---|---|---|---|---|---|
| 3,466,802 | A | * | 9/1969 | Juozas et al. | 49/428 |
| 3,466,803 | A | | 9/1969 | Packett | |
| 3,720,449 | A | | 3/1973 | Godin | |
| 4,069,617 | A | * | 1/1978 | Koike | 49/428 |
| 4,114,945 | A | * | 9/1978 | Lutz | 16/93 R |
| 4,509,229 | A | | 4/1985 | Salice | |
| 4,829,630 | A | * | 5/1989 | Church et al. | 16/93 R |
| 4,882,805 | A | * | 11/1989 | Campbell et al. | 16/93 R |
| 4,935,986 | A | * | 6/1990 | Church et al. | 16/93 R |
| 5,036,621 | A | | 8/1991 | Iwasaki | |
| 5,120,151 | A | * | 6/1992 | Farris et al. | 403/24 |
| 5,560,084 | A | | 10/1996 | Baker | |
| 5,598,606 | A | | 2/1997 | Jacobs | |
| 5,647,094 | A | * | 7/1997 | Mariel | 16/93 R |
| 5,724,769 | A | | 3/1998 | Cripe et al. | |
| 5,771,534 | A | | 6/1998 | Church | |
| 5,836,110 | A | | 11/1998 | Buening | |
| 6,071,453 | A | | 6/2000 | Church | |
| 6,295,762 | B1 | * | 10/2001 | Nemoto | 49/374 |

FOREIGN PATENT DOCUMENTS

| | | | | | |
|---|---|---|---|---|---|
| DE | 3540347 | C | * | 2/1987 | E05D/15/10 |
| JP | 2000248829 | A | * | 9/2000 | E05F/11/38 |
| JP | 2003262071 | A | * | 9/2003 | E05F/11/48 |

* cited by examiner

*Primary Examiner*—Chuck Y. Mah
(74) *Attorney, Agent, or Firm*—Clark Hill PLC

(57) ABSTRACT

A slider (10) is provided for use with an elongated channel (12) having a pair of spaced apart side walls (14, 16) interconnected by a base wall (18) and an upper wall (20, 22) projecting from each side wall spaced from and generally parallel to the base wall. The slider has a body portion (30) defined by a top surface (32), bottom surface (34) and plurality of side surfaces (36) interconnecting the top and bottom surfaces. The slider also has a plurality of axial slots (42) extending between the top and bottom surfaces adjacent each side surface and a plurality of lateral slots (52) extending between each of the side surfaces and the respective axial slot (42) for allowing the side surface to flex and bias the slider between the side walls of the channel (12). The slider (10) further has a plurality of raised ridges (44) projecting from each of the top and bottom surfaces for flexing and biasing the slider between the upper walls and the base wall of the channel. Finally, the slider includes a plurality of semi-spherical embosses (48) extending from the top and bottom surfaces for slidably engaging and guiding the slider between the upper walls and the base wall within the channel (12).

14 Claims, 2 Drawing Sheets

WINDOW REGULATOR CHANNEL SLIDER DEVICE

This application claims the benefit of Provisional application Ser. No. 60/235,688, filed Sep. 27, 2000.

FIELD OF THE INVENTION

This invention relates to a slider device. In particular, this invention relates to a slider device slidably received in a window regulator channel for raising and lower a window of an automotive vehicle.

BACKGROUND OF THE INVENTION

Automotive vehicles commonly include driver and passenger doors for providing ingress and egress to the vehicle. These doors also commonly include window panes slidably coupled to the door for sliding movement between an open and closed position. A window regulator is typically coupled between the door and the window pane for moving the window pane between the open and closed positions. The window regulator typically includes one or more elongated channels mounted to the door for slidably receiving and guiding a slider therein The window pane is coupled to the slider and a drive mechanism moves the slider along the channel to actuate the window pane between the open and closed positions. However, the slider has a tendency to rattle within the channel creating undesirable noise within the vehicle during operation.

Various prior art devices have been deployed in an effort to reduce or prevent the rattle of the slider within the channel. For example, U.S. Pat. Nos. 4,829,630 and 4,935,986 disclose a one-piece molded plastic slider having integral projections extending laterally in two directions so that the slider is biased within the channel in two directions against rattling. The channel includes spaced apart and parallel side walls, a base wall interconnecting the side walls and an upper wall parallel to the base wall and having an elongated slot therein A first set of lateral projections engage the respective side walls and a second set of lateral projections engage the base wall. However, the slider is not biased against the top wall of the channel and the lateral projections have a tendency of frictionally impeding travel of the slider within the channel.

SUMMARY OF THE INVENTION

The disadvantages of the prior art may be overcome by providing a slider which is biased against the side walls of the channel as well as between the top and bottom walls of the channel to enable longitudinal rattle-free travel of the slider along the channel.

According to one aspect of the invention, there is provided a slider for slidably engaging within an elongated C-shaped channel of a window regulator. The slider has a body portion having a top surface, bottom surface and plurality of side surfaces interconnecting the top and bottom surface. A plurality of axial slots extends between the top surface and the bottom surface, adjacent each of the side surfaces. A plurality of lateral slots extend through each of the side surfaces to a respective axial slot enabling portions of the side surfaces to flex. A first plurality of raised ridges project from the top surface adjacent each of the side surfaces and the axial slots. A second plurality of raised ridges project from the bottom surface adjacent each of the side surfaces and the axial slots. The slots and ridges cooperate to maintain frictional rattle-free longitudinal travel of the slider within the channel.

According to another aspect of the invention, there is provided a slider adapted to be slidably received within an elongated channel having a pair of spaced side walls interconnected by a planar base wall and an upper wall extending from each side wall spaced from and generally parallel to the base wall. The slider comprises a body portion having a top surface, bottom surface and plurality of side surfaces interconnecting the top and bottom surface. A plurality of axial slots extend between the top surface and the bottom surface adjacent each of the side surfaces and a plurality of lateral side slots extending through each of the side surfaces to the respective axial slot for allowing portions of the side surfaces to flex against the side walls of the channel. A first plurality of raised ridges project from the top surface adjacent each of the side surfaces and the axial slots and a second plurality of raised ridges projecting from the bottom surface adjacent each of the side surfaces and the axial slots for engaging and flexing against the upper walls and the base wall, respectively, within the channel.

The slider further includes a plurality of semi-spherical embosses projecting from the top and bottom surfaces for engaging with the upper walls and base wall of the channel and provide free sliding movement of the slider within die channel.

BRIEF DESCRIPTION OF THE DRAWINGS

In drawings which illustrate embodiments of the present invention.

DETAILED DESCRIPTION OF THE PREFERRED EMBODIMENT

Figure 1:
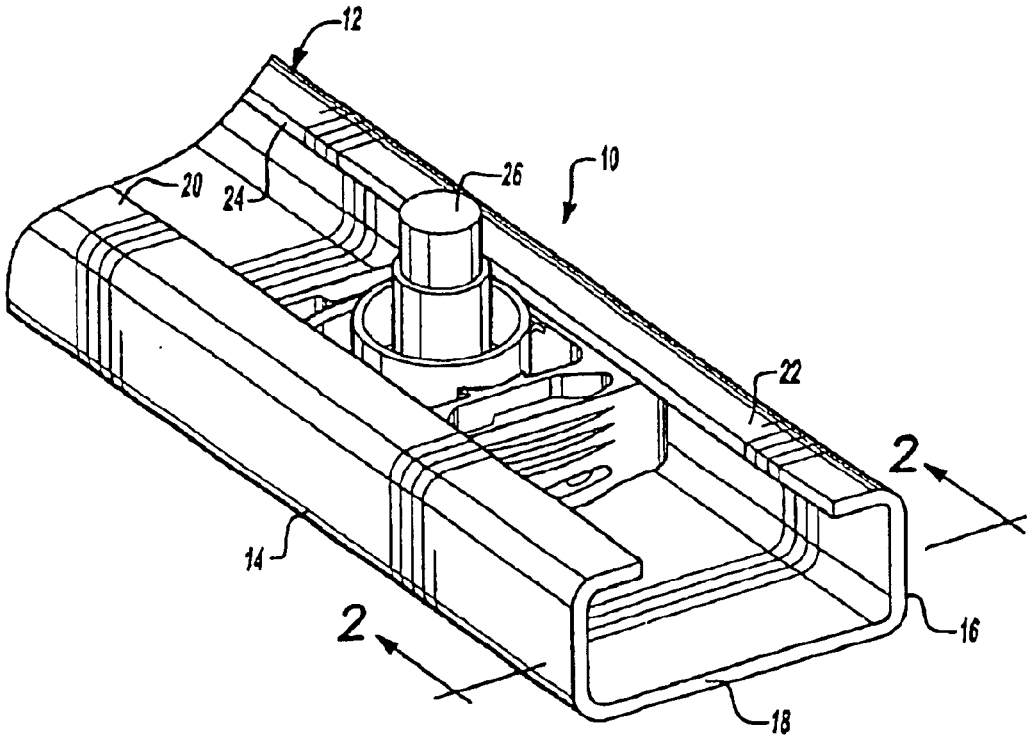
FIG. 1 is a perspective view of a slider device according to the present invention slidably received in a window regulator channel.
Figure 2:
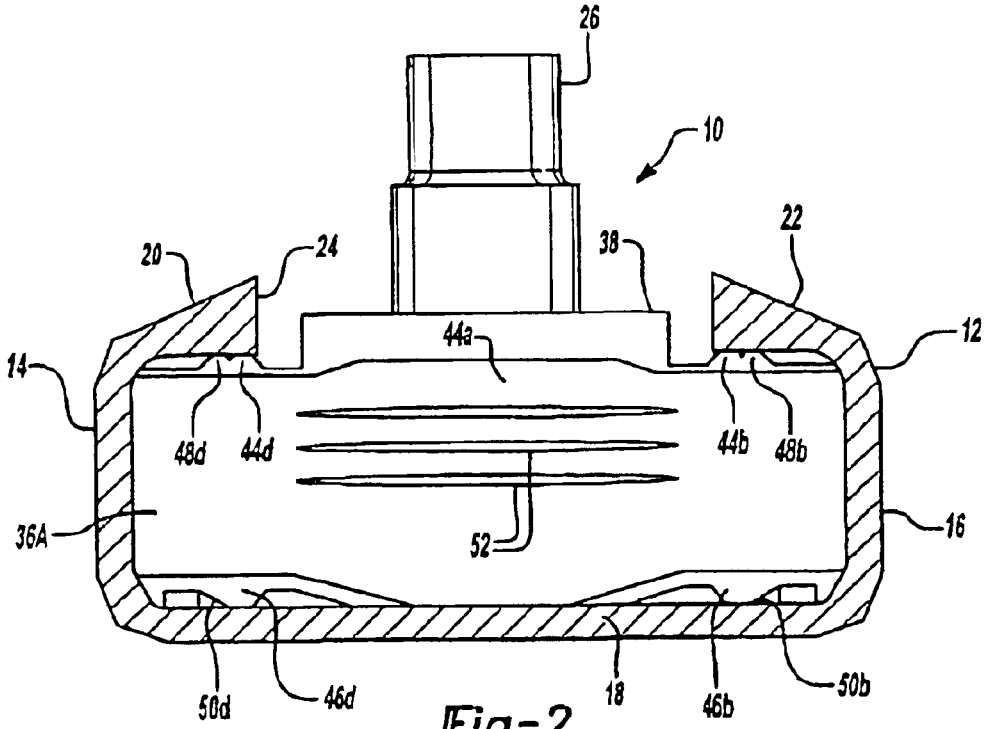
FIG. 2 is a cross-sectional view taken along line 2—2 of FIG. 1.

Referring to FIGS. 1 and 2, the slider 10 is generally shown within an elongated window regulator channel 12. The channel 12 is an open C-shape including a pair of spaced apart and parallel side walls 14, 16 interconnected by a planar base wall 18. An upper wall 20, 22 extends inwardly from each of the side walls 14, 16 and is spaced from and parallel to the base wall 18. An elongated slot 24 is formed between the opposing ends of the upper walls 20, 22 through which a connecting rod 26 projects for mounting a window pane to the slider 10. The channel 12 is conventionally known to one skilled in the art and is fixedly secured to the interior panel of a vehicle door. A drive mechanism, also commonly known to one skilled in the art, may be provided for driving the slider 10 within the channel 12 for moving the windowpane between an open and closed position.

Figure 3:
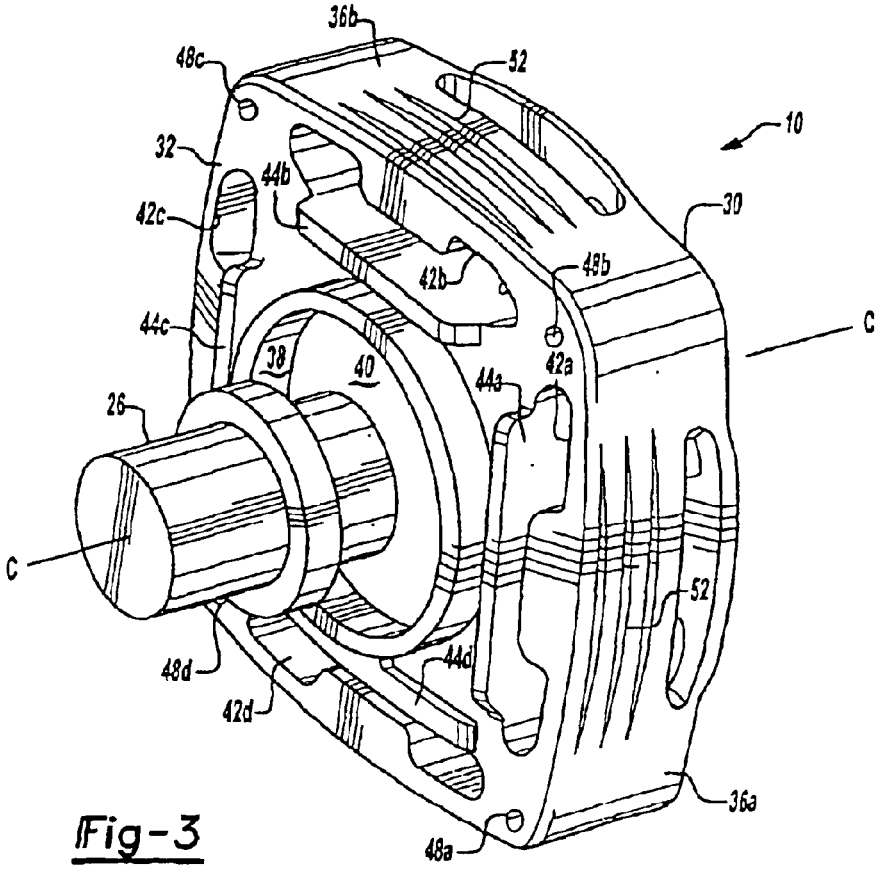
FIG. 3 is a front perspective view of the slider device.
Figure 4:
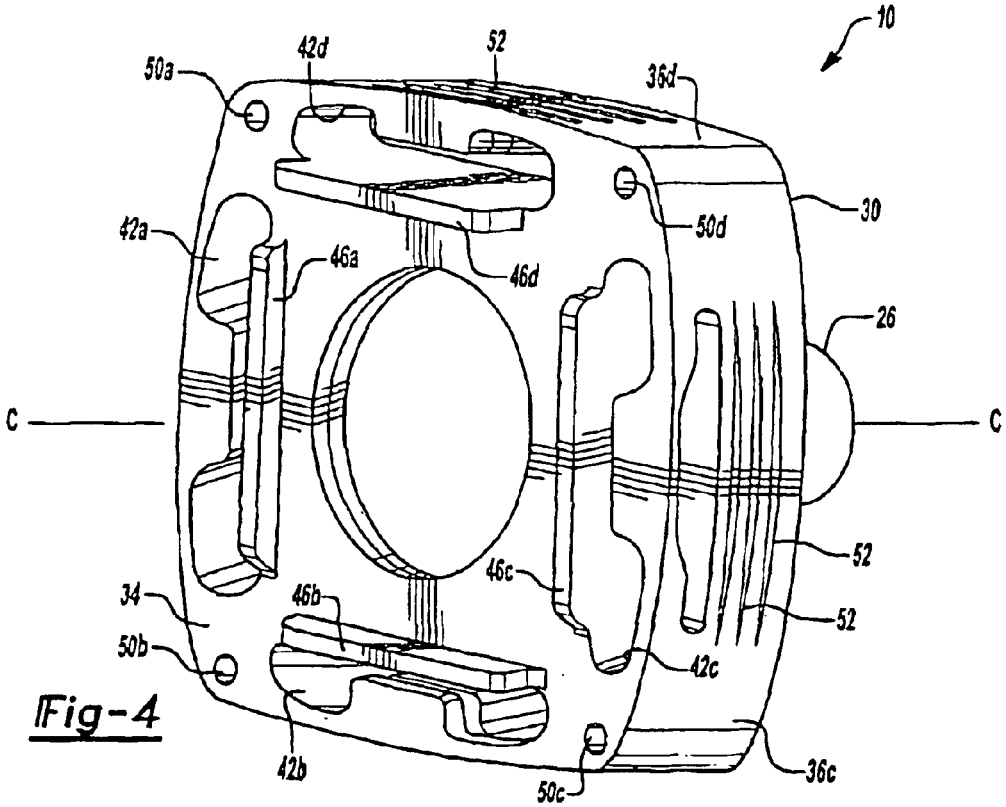
FIG. 4 is a rear perspective view of the slider device.

Referring to FIGS. 3 and 4, the slider 10 is a solid body one-piece molded part of plastic having good stability, resiliency and low coefficient of friction characteristics. The slider 10 includes a generally rectangular body portion 30 having a top surface 32, opposing bottom surface 34 and lateral side surfaces 36*a*, 36*b*, 36*c*, 36*d* extending between the top 32 and bottom 34 surfaces. The slider 10 includes a concave bowl 38 recessed in the center of the top surface 32 and defining a center axis C for pivotally receiving and supporting a ball socket 40 on the distal end of the connecting rod 26.

The slider 10 further includes a plurality of elongated slots 42*a*, 42*b*, 42*c*, 42*d* extending axially between the top surface 32 and the bottom surface 34 adjacent and generally parallel to the respective side surfaces 36*a*, 36*b*, 36*c*, 36*d*. A plurality of elongated raised ridges 44*a*, 44*b*, 44*c*, 44*d* project axially from the top surface 32 adjacent the respective elongated slots 42*a*, 42*b*, 42*c*, 42*d* and a similar plurality of elongated raised ridges 46*a*, 46*b*, 46*c*, 46*d* project axially from the bottom surface 34 adjacent the respective elongated slots 42*a*, 42*b*, 42*c*, 42*d*. The slider 10 further includes a plurality of raised semispherical embosses 48*a*, 48*b*, 48*c*, 48*d* projecting from the top surface 32 between each of the side surfaces 36*a*, 36*b*, 36*c*, 36*d*. Similarly, a plurality of raised semi-spherical embosses 50*a*, 50*b*, 50*c*, 50*d* project from the bottom surface 34 between each of the side surfaces 36*a*, 36*b*, 36*c*, 36*d*.

The slider 10 also includes a plurality of elongated lateral side slots 52 extending through each of the side surfaces 36*a*, 36*b*, 36*c*, 36*d* to the elongated axial slots 42*a*, 42*b*, 42*c*, 42*d* and generally parallel to the top 32 and bottom 34 surfaces.

The slider 10 of the preferred embodiment of FIGS. 3 and 4 is generally square, and thus, presents a symmetrical shape between each of the side surfaces 36*a*, 36*b*, 36*c*, 36*d* for assembly within the channel 12.

Referring again to FIGS. 1 and 2, the slider 10 is shown slidably received within the channel 12. The slider 10 is received within the channel 12 with the recessed bowl 38 centered in the slot 24 and the connecting rod 26 projecting therethrough. The lateral side slots 52 allow the various sections of the sides surfaces 36*a*, 36*b*, 36*c*, 36*d*, separated thereby, to flex inwardly when pressed against and between the side walls 14, 16 of the channel 12. Additionally, the raised ridges 44*b*, 44*d*, 46*b*, 46*d* are flexed between the upper walls 20, 22 and the base wall 18, respectively. Therefore, the slider 10 is slidably retained within the channel while the lateral side slots 52 provide openings for grease within the channel 12 and the raised ridges 44*a–d*, 46*a–d* prevent both lateral movement of the slider 10 between the side walls 14, 16 and vertical movement of the slider 10 between the upper walls 20, 22 and the base wall 18 to reduce noise and rattle therebetween. Finely, the spherical embosses 48*a*, 48*b*, 48*c*, 48*d* slide in contact with the upper walls 20, 22 and the spherical embosses 50*a*, 50*b*, 50*c*, 50*d* slide in contact with the base wall 18 to reduce the sliding friction and anti-chucing between the slider 10 and the channel 12.

The above-decribed embodiment of the invention is intended to be an example of the present invention and alterations and modifications may be effected thereto, by those of skill in the art, without departing from the scope of the invention as defined by the attached claims.

What is claimed is:

1. A slider for slidably engaging within an elongated C-shaped channel of a window regulator, said slider comprising:

a body portion having a top surface, bottom surface and plurality of side surfaces interconnecting said top and bottom surface;

a plurality of axial slots extending between said top surface and said bottom surface, adjacent each of said side surfaces, and a plurality of lateral slots extending through each of said side surfaces to said respective axial slot enabling portions of said side surfaces to flex; and a first plurality of raised ridges projecting from said top surface adjacent each of said side surfaces and said axial slots and a second plurality of raised ridges projecting from the bottom surface adjacent each of said side surfaces and said axial slots, said slots and ridges cooperating to maintain frictional longitudinal travel of said slider within said channel.

2. A slider as set forth in claim 1 further including a plurality of semi-spherical embosses projecting from said top surface.

3. A slider as set forth in claim 2 further including a plurality of semi-spherical embosses projecting from said bottom surface.

4. A slider as set forth in claim 3 wherein said semi-spherical embosses project from said top and bottom surfaces adjacent and between each of said adjacent side surfaces.

5. A slider as set forth in claim 4 further including a concave bowl recessed in the center of the top surface and defining a center axis adapted for pivotally receiving a ball socket of a connecting rod.

6. A slider as set forth in claim 5 wherein said slider is axisymmetric about said center axis.

7. A slider as set forth in claim 6 wherein said slider is a solid body one-piece molded member.

8. A slider adapted to be slidably received within an elongated channel having a pair of spaced side walls interconnected by a planar base wall and an upper wall extending from each side wall spaced from and generally parallel to the base wall and defining an elongated slot therebetween, said slider comprising:

a body portion having a top surface, bottom surface and plurality of side surfaces interconnecting said top and bottom surface;

a plurality of axial slots extending between said top surface and said bottom surface adjacent each of said side surfaces and a plurality of lateral side slots extending through each of said side surfaces to said respective axial slot for allowing portions of said side surfaces to flex against the side walls of the channel; and a first plurality of raised ridges projecting from said top surface adjacent each of said side surfaces and said a slots and a second plurality of raised ridges projecting from the bottom surface adjacent each of said side surfaces and said axial slots for engaging and flexing against the upper walls and the base wall, respectively, of the channel when said slider is disposed therein to prevent both lateral and vertical movement and rattle within the channel.

9. A slider as set forth in claim 8 further including a plurality of semi-spherical embosses projecting from said top surface for engaging with the upper walls of the channel and provide free sliding movement of said slider within the channel.

10. A slider as set forth in claim 9 further including a plurality of semi-spherical embosses projecting from said bottom surface for engaging with the base wall of the channel and provide free sliding movement of said slider within the channel.

11. A slider as set forth in claim 10 wherein said semi-spherical embosses project from said top and bottom surfaces adjacent and between each of said adjacent side surfaces.

12. A slider as set forth in claim 11 further including a concave bowl recessed in the center of the top surface and defining a center axis adapted for pivotally receiving and supporting a ball socket of a connecting rod.

13. A slider as set forth in claim 12 wherein said slider is axisymmetric about said center axis.

14. A slider as set forth in claim 13 wherein said slider is a solid body one-piece molded member.

* * * * *